United States Patent [19]

Bogar et al.

[11] Patent Number: 4,824,399

[45] Date of Patent: Apr. 25, 1989

[54] PHASE SHIFTER

[75] Inventors: Jerry H. Bogar; Edgar W. Forney, both of Harrisburg, Pa.

[73] Assignee: AMP Incorporated, Harrisburg, Pa.

[21] Appl. No.: 198,630

[22] Filed: May 20, 1988

Related U.S. Application Data

[63] Continuation of Ser. No. 64,166, Jun. 19, 1987, abandoned.

[51] Int. Cl.[4] ..... H01R 17/18

[52] U.S. Cl. ..... 439/578; 439/642; 29/747

[58] Field of Search ..... 439/578–585, 439/98, 99, 675, 752, 732, 642; 29/747

[56] References Cited

U.S. PATENT DOCUMENTS

| | | | |
|---|---|---|---|
| 3,161,453 | 12/1964 | Powell | 339/177 |
| 3,343,122 | 9/1967 | Drogo | 339/177 R |
| 3,437,960 | 4/1969 | Ziegler, Jr. | 439/578 |
| 3,439,294 | 4/1969 | Flanagan et al. | 333/33 |
| 3,460,072 | 8/1969 | Ziegler, Jr. | 439/585 |
| 3,474,391 | 10/1969 | Gartzke | 339/103 |
| 3,757,278 | 9/1973 | Schumacher | 339/177 R |
| 4,035,054 | 7/1977 | Lattanzi | 439/578 |
| 4,326,769 | 4/1982 | Dorsey et al. | 439/578 |
| 4,431,255 | 2/1984 | Banning | 439/578 |
| 4,596,435 | 6/1986 | Bickford | 439/578 |

*Primary Examiner*—David Pirlot

*Attorney, Agent, or Firm*—Gerald K. Kita

[57] ABSTRACT

A phase shifter (1) in the form of an electrical connector comprises; an elongated conductive shell (2) of fixed length, electrical connector coupling means (5,6) at the ends (7,8) of the transmission line, an elongated passage (3) extending through the shell (2), an elongated electrical conductor (4) of fixed length extending through the passage, electrical contact means (22,23) at the ends of the conductor (4) for electrical coupling of the conductor (4) along the corresponding electronic transmission line, first dielectric means (31) and second dielectric means (43) concentrically encircling the conductor (4) within the passage (3), a conductive sleeve (38) within the passage (3) in engagement with the shell (2), and the second dielectric means (43) is between the sleeve (38) and the conductor (4).

9 Claims, 3 Drawing Sheets

PHASE SHIFTER

This application is a continuation of application Ser. No. 064,166, filed June 19, 1987, now abandoned.

FIELD OF THE INVENTION

The invention relates to a phase shifter for shifting the phase of an electronic communications signal of known frequency, and more particularly to a phase shifter in the form of an electrical connector.

BACKGROUND OF THE INVENTION

In the field of electronic communications, an electronic signal of known frequency propagates over a signal transmission line of known dielectric constant. The transmission line may be required to provide a shift in the phase of the signal by a small and precise amount, for example, to adjust the signal with a desired phase angle.

For a fixed frequency signal, a phase shift through a transmission line is dependent upon the electrical length of the transmission line. The electrical length, in turn, is dependent upon the physical length of the transmission line and the dielectric constant of the transmission line.

It is known to provide a phase shift along a transmission line of unchanging dielectric constant, by providing a lengthened or shortened transmission line.

A desired phase shift along a transmission line can be accomplished by coupling a phase shifter in the form of an electrical connector along the transmission line, as an alternative to the known technique of lengthening or shortening the transmission line. To provide a phase shift, for example, to adjust a signal of fixed frequency to a desired phase angle, one connector must be selected from a supply of connectors. If the different electrical lengths are produced by connectors of different physical lengths, the length of the connector selected would cause a corresponding variation in the physical length of the transmission line.

An advantage would reside in an electrical connector constructed for achieving a variable electrical length within a constant or fixed physical length. Connectors of the same physical length could be interchanged with one another to produce a phase shift within a relatively wide range without lengthening or shortening the transmission line. Adjustment of the phase shift to a desired phase angle can be accomplished by interchanging the connectors without increased consumption of space allowed along the transmission line for the connector.

U.S. Pat. No. 3,757,278 discloses a known connector assembly having an elongated center contact concentrically surrounded by two dielectric sleeves spaced apart along a center contact, and supporting the center contact concentrically within a conductive connector housing. The known connector assembly is not intended to be a phase shifter, and particularly, not a phase shifter having a fixed physical length and a variable electrical length.

An object of the invention is to provide a phase shifter by design in the form of an electrical connector.

Another object is to provide a phase shifter in the form of an electrical connector having a fixed physical length and a variable electrical length.

SUMMARY OF THE INVENTION

An aspect of the invention is directed to a method for selecting a phase shift along an electrical transmission line of fixed physical length and in the form of an electrical connector having a conductive shell of fixed length and a conductor of fixed length extending through a passage of the shell, comprising the steps of; providing electrical contacts at corresponding ends of the conductor, providing electrical coupling means at corresponding ends of the shell, providing a first dielectric means and a second dielectric means and a third dielectric means serially along the conductor, varying selectively an electrical length of the transmission line while maintaining a fixed physical length of the transmission line by selectively varying the proportion of individual physical lengths of the first dielectric means and the second dielectric means in relation to a constant sum of the individual physical lengths, and supporting the conductor concentrically within the shell by the first dielectric means and the third dielectric means.

A further aspect of the invention resides in a phase shifter in the form of an electrical connector comprising, a conductive shell, coupling means on the ends of the shell for coupling the shell along a corresponding electronic transmission line, a passage extending through the shell, an electrical conductor extending through the passage, electrical contacts on the ends of the conductor for coupling the conductor along the corresponding electronic transmission line, first and second and third dielectric means serially along the passage and concentrically encircling the conductor, and a conductive sleeve in the passage engaging the shell, the second dielectric means being concentrically between the sleeve and the conductor Other advantages of the invention are apparent from a detailed description that follows and from accompanying drawings, wherein;

DETAILED DESCRIPTION

Figure 1:
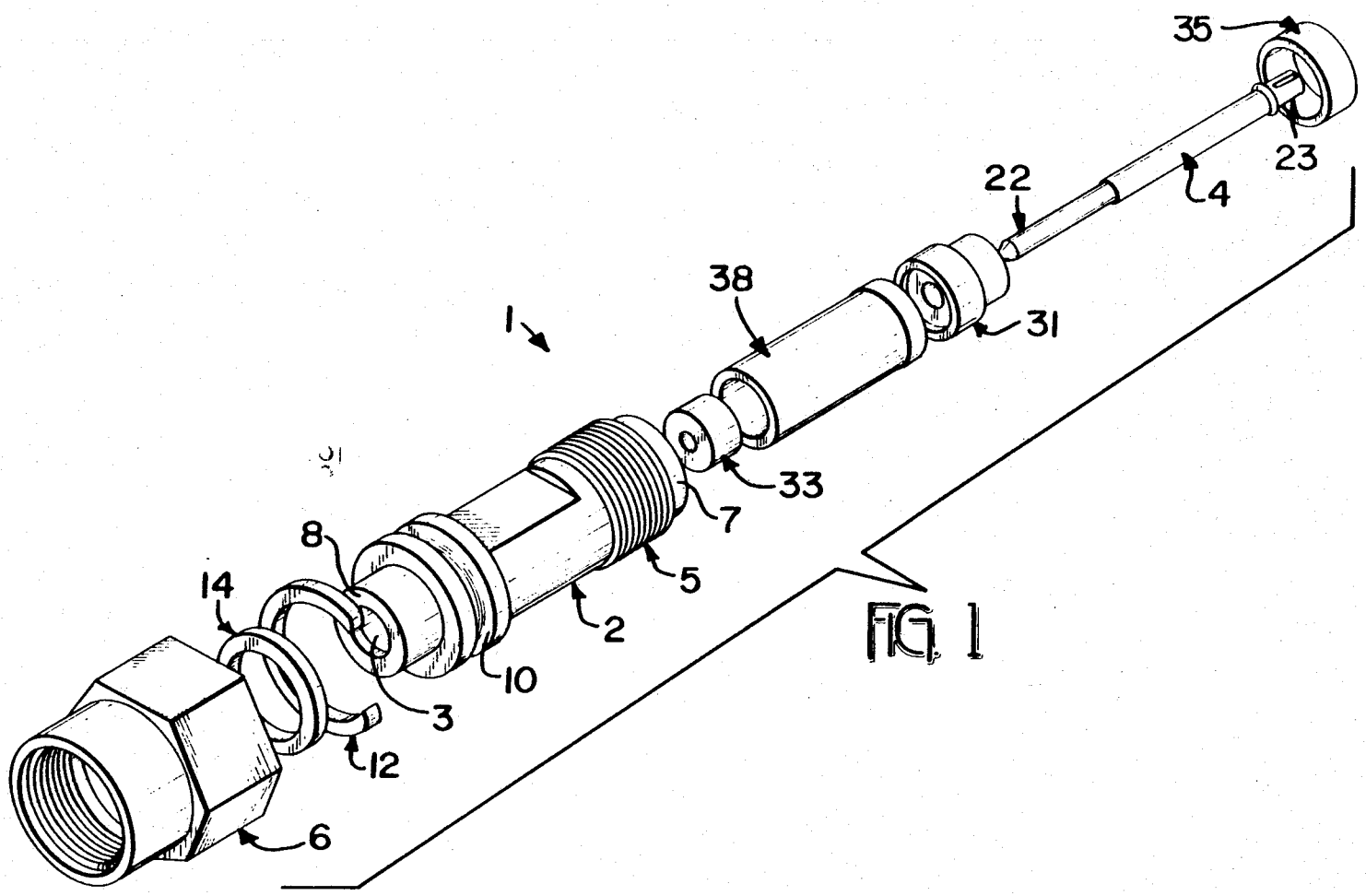
FIG. 1 is an enlarged perspective view of a phase shifter in the form of an electrical connector, with parts in exploded configuration.

A phase shifter 1 in the form of an electrical connector includes a conductive shell 2 of fixed length or constant length. A passage 3 extends through the shell 2. An electrical conductor 4 of fixed length or constant length extends through the passage 3.

Electrical coupling means 5,6 on corresponding ends of 7,8 of the shell 2 adapt the shell 2 for electrical coupling to a transmission line, not shown. For example, the coupling means 5 comprises raised helical threads 5 on the exterior of the corresponding end 7 of the shell 2, and the coupling means 6 comprises a hollow nut 6 having internal helical threads 9 on a distal end of the nut 6 and mounted for rotation over the end 8 of the shell 2.

The shell 2 and the nut 6 are provided with radially aligned grooves 10,11. A split ring 12 is radially expansible and is assembled over the end 8 of the shell 2 and is passed along the shell until registration with the groove 10 of the shell 2. The nut 6 is assembled over the ring 12, which undergoes radial contraction to allow passage of the nut 6 over the ring 12. The ring 12 undergoes radial expansion and fills the groove 11 of the nut 6 and is retained in the groove 10 of the shell 2. The end 8 of the shell 2 is on a reduced diameter portion 13 of the shell 2. A sealing ring 14 of compressible elastomeric material encircles the reduced diamter portion 13 is in registration against a wall 15 extending radially and facing in a direction axially and toward the end 8 of the shell 2. A radially inward projecting flange 16 on the end 8 of the shell 2 projects into the passage 3.

The passage 3 includes an enlarged diameter counterbore 17 aligned axially with a reduced diameter portion 18 of the passage 3. A shoulder 19 is defined at the intersection of the counterbore 17 and the portion 18 of the passage 3 and is axially aligned with the counterbore 17. An enlarged diameter recess is in the end 7 of the passage 3 and is axially aligned with the counterbore. A second shoulder 21 is defined at an intersection of the counterbore 17 and the recess 20.

Electrical contacts 22,23 at corresponding ends of the conductor 4 adapt the conductor 4 for coupling to a signal transmitting portion of a transmission line, not shown. For example, the contact 23 is a receptable 23 of sleeve form with an open end 24. A series of spaced apart axial slots 25, one of which is shown, communicate with the open end 24. A projecting barb 26 of frustoconical shape encircles the contact 23 and projects toward the open end 24.

For example, the contact 22 is a pin 22 having a reduced diameter portion 27 extending outwardly from the passage 3 to a tapered end 28, and extending into the passage 3 and intersecting an enlarged diameter portion 29 of the conductor 4. A shoulder 30 is defined at the intersection of the reduced diameter portion 27 and the enlarged diameter portion 29. The enlarged diameter portion 29 extends from the shoulder 30 to the barb 26 of the contact 23.

A dielectric means 31, for example, a stepped cylindrical insulating body 31 of dielectric material, concentrically surrounds the contact 23. The dielectric means 31 has an axial bore 32 having a diameter that receives the sleeve form of the contact 23 with a freely sliding fit. The barb 26 is of large diameter than the bore 32 and fits within the bore 32 with a wedge fit. The dielectric means 31 is assembled over and along the reduced diameter portion 27 and along the enlarged diameter portion 29 and into a position encircling the contact 23. The barb 26 penetrates into the dielectric means 31 to lock the dielectric means 31 at the desired position.

A dielectric means 33, for example, a cylindrical body 33 of dielectric material, concentrically surrounds the conductor 4. The dielectric means 33 has an axial bore 34 that receives the reduced diameter portion 27. The dielectric means 33 is assembled over and along the reduced diameter portion 27 and axially engages the shoulder 30.

The dielectric means 31,33 are assembled over the conductor 29. The assembled conductor 29 and dielectric means 31,33 are inserted into and along the passage 3 until the dielectric means 33 engages the lip 16. A metal ring 35 is assembled in the recess 20. An outer diameter of the ring 35 fits with a wedge fit in the recess 20. The ring 35 engages the shoulder 21 and overlaps a shoulder 36 on the dielectric means 31 to retain the dielectric means 31 in the counterbore 17. Air provides dielectric material in an annular gap 37 concentrically between the ring 35 and the dielectric means 31 and compensates for an abrupt change of electrical impedance that would be caused at an abrupt change in diameter at the intersection of the shoulder 21 of the shell 2 and the ring 35.

Figure 3:
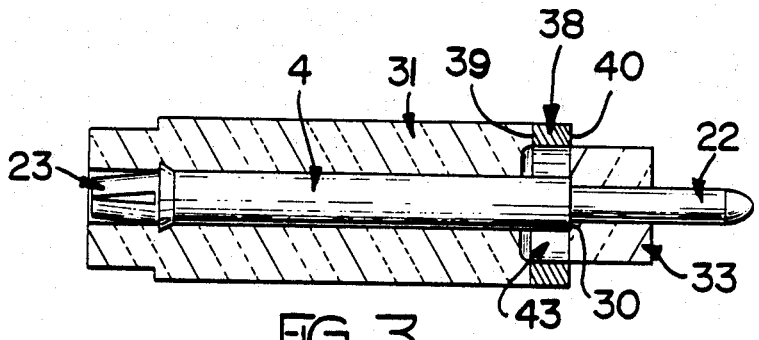
FIG. 3 is an enlarged elevation view of an adjustable portion of the phase shifter shown in FIG. 2.

In the phase shifter 1 shown in FIGS. 1 and 3, a conductive sleeve 38 is concentrically between the shell 2 and the conductor 4, and is serially along the conductor 4 between the dielectric means 31 and the dielectric means 33. The sleeve 38 outer diameter engages the shell 2. The sleeve 38 is assembled over the conductor 4 together with the dielectric means 31,33, with an end 39 of the sleeve 38 engaging the dielectric means 31, before assembly of the conductor 4 into the passage 3. An end 40 of the sleeve 38 is aligned with the shoulder 30 of the conductor 4 and is inserted along the counterbore 17 until it engages the shoulder 19 of the shell 2.

Each dielectric means 31,33 includes a corresponding annular recess 41,42 extending radially from the external diameter of the conductor 4 to the inner diameter of the shell 2. Air in the corresponding recess 41,42 provides compensation for an abrupt change of electrical impedance that would be caused by an abrupt change in corresponding diameter of th conductor 4 or of the shell 2.

An annular shaped area 42 is defined along the conductor 4 and between the dielectric means 31 and the dielectric means 33. A dielectric means 43, for example, air is in the area and concentrically encircles the conductor. The dielectric means 31,43 and 33 are serially of one another along the conductor 4.

At a fixed frequency, the phase shift through a transmission line is determined by its electrical length. In turn. the electrical length depends on the physical length and the dielectric constant of the transmission line. The physical length of the transmission line can remain constant while the electrical length can be variable to produce a selected phase shift through the transmission line. To change the electrical length while maintaining the same physical length consider two cascaded transmission lines as in the following diagram.

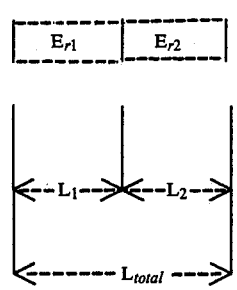

The overall physical length is the sum of the individual physical lengths.

$$L_{tot}=L_1+L_2.$$

The same is true of the electrical length but the electrical length also depends on the dielectric constant, a composite of $E_{r1}$ and $E_{r2}$ so that:

$$\begin{aligned} L_{tot}\,(\text{Electric}) &= L_1\sqrt{E_{r1}} + L_2\sqrt{E_{r2}} \\ \text{OR } L_{tot}\,(\text{Electric}) &= L_1\sqrt{E_{r1}} + (L_{tot} - L_1)\sqrt{E_{r2}} \\ &= L_1(\sqrt{E_{r1}} - \sqrt{E_{r2}}) + L_{tot}\sqrt{E_{r2}} \end{aligned}$$

The overall electrical length can be changed with no change in the physical length $$\Delta L_{tot}(\text{Electric})=\Delta L_1(\sqrt{E_{r1}}-\sqrt{E_{r2}}).$$

For example, assume $L_{tot}=0.500$ inches and that dielectric of $L_2$ is air, $E_{r2}=1$, and dielectric of $L_1$ is polytetrafluorethylene, $E_{r1}=2.03$. If $L_1=0$, $L_{tot}$ (Electric)=0.500 inches. If $L_2=0$, then $\Delta L_{tot}$ (Electric)=0.500 $(\sqrt{2.03}-\sqrt{1})=0.212$ inches. Thus the electric length has increased by 0.212 inches with no increase in physical length. At a particular frequency, this increased electrical length will appear as a phase shift. $\Delta\phi$, determined by $$\Delta\phi=\Delta L_{tot}(\text{Electric})\times(360°)\times c/f$$

where c=velocity of propagation=$1.18\times10^{10}$ inches/sec f=frequency in hertz.

For the above example at 18 GHz the total phase shift would be $$\Delta\phi = .212 \times 360 \times \frac{(18) \times 10^9}{1.18 \times 10^{10}} = 116.4°$$

Figure 4:
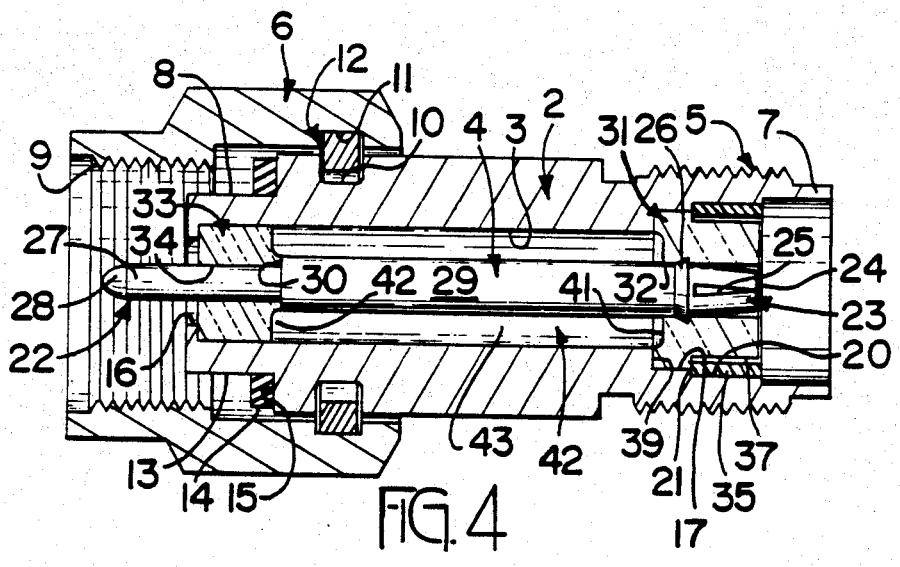
FIG. 4 is an enlarged elevation view in section of an alternate constuction of a phase shifter.
Figure 2:
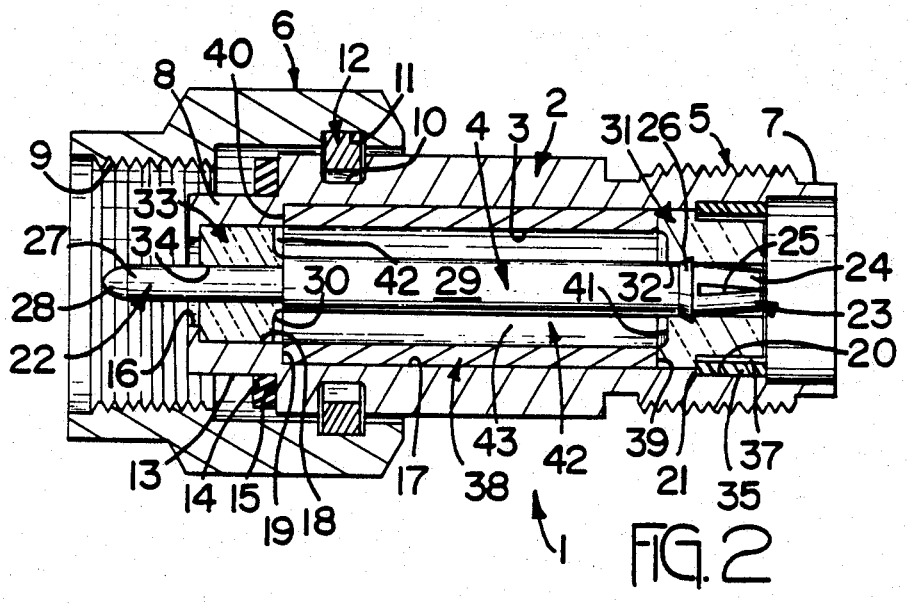
FIG. 2 is an enlarged elevation view in section of the phase shifter shown in FIG. 1.

In the phase shifter, varying selectively the electrical length while maintaining a fixed physical length of the phase shifter 1 is accomplished by, selectively varying the proportion of the individual lengths of the dielectric means 33,43 of FIG. 1, or, alternative by the dielectric means 31,43 of FIG. 4, in relation to a constant sum of the individual physical lengths.

Varying the electrical length is acomplished in the phase shifter 1 of FIG. 1 by increasing the axial length of the dielectric means 31 by a selected amount and decreasing the axial length of the dielectric means 43 by a corresponding amount. The sleeve 38 can be supplied at a maximum length as shown in FIG. 1 and then cut to a desired shortened length. The axial length of the dielectric means 31 can be varied within a range from the minimum shown in FIG. 1 to a maximum shown in FIG. 3.

Figure 5:
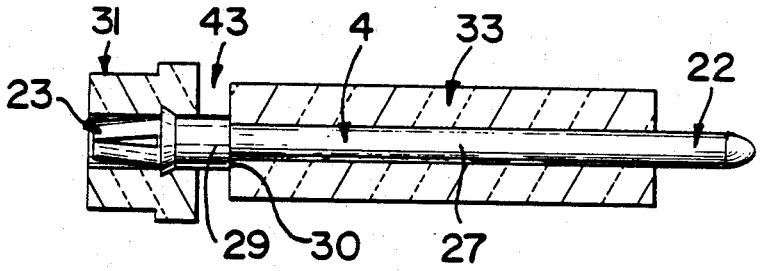
FIG. 5 is an enlarged elevation view of an adjustable portion of the phase shifter shown in FIG. 4.

Varying the electrical length is accomplished in the phase shifter 1 of FIG. 4 by increasing the axial length of the dielectric means 33 by a selected amount, and the axial length of the reduced diameter portion 27 of the conductor 4 by a corresponding amount, and decreasing the length of the dielectric means 43 by a corresponding amount. The conductor 4 can be supplied with the minimum length of reduced diameter portion 27, and then the enlarged diameter portion 29 can be machined to extend the axial length of the reduced diameter portion 27, within a range from the minimum shown in FIG. 4 to a maximum shown in FIG. 5. The axial length of the dielectric means 33 can be varied within a range from the minimum shown in FIG. 4 to a maximum shown in FIG. 5.

We claims:

1. A method for selecting a phase shift along an electrical transmission line of fixed physical length and in the form of an electrical connector comprising, an elongated conductive shell of fixed length, electrical connector coupling means at the ends of the shell for coupling the shell along a corresponding electronic transmission line, an elongated passage extending through the shell, an elongated electrical conductor of fixed length extending through the passage, and electrical contact means at the ends of the conductor for electrical coupling of the conductor along the corresponding electronic transmission line, the method comprising the steps of:

selecting a first dielectric means and a second dielectric means directly together in series for concentrically encircling the conductor, varying selectively an electrical length of the transmission line while maintaining a fixed physical length of the transmission line by selectively varying the proportion of the individual physical lengths of the first dielectric means and the second dielectric means in relation to a constant sum of the individual physical lengths, supporting the conductor concentrically within the passage by a third dielectric means and encircling concentrically the conductor with the first dielectric means and the second dielectric means within the passage.

2. A method as recited in claim 1, and further including the step of: inserting a conductive sleeve within the passage in engagement with the shell and the second dielectric means is between the sleeve and the conductor.

3. A method as recited in claim 1, and further including the step of: reducing a diameter of the conductor along a length of the conductor to be encircled concentrically by the first dielectric means.

4. A method as recited in claim 1, and further including the step of: supporting the conductor concentrically by the third dielectric means within an enlarged counterbore of the passageway.

5. A method as recited in claim 1, and further including the step of producing a phase shift of an electrical signal with a known frequency propagating along the transmission line, as a function of increasing electrical length determined by:

$$\Delta\phi=\Delta L_{tot}(\text{Electric})\times(360°)\times c/f$$

wherein: c=velocity of propagation=$1.8\times10^{10}$ in/-sec and wherein: f=frequency, hertz.

6. A method as recited in claim 1, and further including the steps of:

making a plurality of electrical connectors each with a different axial length of said first dielectric means, and coupling a selected one of said connectors along the transmission line to produce a desired phase shift.

7. A phase shifter in the form of an electrical connector comprising;

an elongated conductive shell of fixed length, electrical connector coupling means at the ends of the shell for coupling the shell along a corresponding electronic transmission line, an elongated passage extending through the shell, an elongated electrical conductor of fixed length extending through the passage, and electrical contact means at the ends of the conductor for electrical coupling of the conductor along the corresponding electronic transmission line, the improvement comprising;

a continuous unstepped diameter portion of the passage, a continuous unstepped diameter portion of the conductor concentrically within the unstepped diameter portion of the passage, first dielectric means and second dielectric means between said unstepped diameter portion of the passage and the unstepped diameter portion of the conductor within the passage, a conductive sleeve having the same outer diameter as the first dielectric means is within the unstepped diameter portion of the passage in engagement with the shell, said first dielectric means comprising an insulating body, and the second dielectric means is between the sleeve and the conductor.

8. In a phase shifter as recited in claim 7, wherein the improvement further comprises; said first dielectric means extends to encircle concentrically a first of said electrical contact means.

9. In a phase shifter as recited in claim 7, wherein the improvement further comprises; said passageway has a reduced diameter portion encircling a second of said electrical contact means, third dielectric means encircles said second of said electrical contact means, and said sleeve is between said first dielectric means and said third dielectric means.

* * * * *